US009746212B2

(12) United States Patent
Kato et al.

(10) Patent No.: US 9,746,212 B2
(45) Date of Patent: Aug. 29, 2017

(54) REFRIGERATING AND AIR-CONDITIONING APPARATUS

(75) Inventors: Yohei Kato, Tokyo (JP); Satoru Yanachi, Tokyo (JP); Kiyoshi Yoshimura, Tokyo (JP); Hirokuni Shiba, Tokyo (JP)

(73) Assignee: Mitsubishi Electric Coroporation, Tokyo (JP)

( * ) Notice: Subject to any disclaimer, the term of this patent is extended or adjusted under 35 U.S.C. 154(b) by 513 days.

(21) Appl. No.: 14/358,372

(22) PCT Filed: Nov. 29, 2011

(86) PCT No.: PCT/JP2011/006618

§ 371 (c)(1), (2), (4) Date: May 15, 2014

(87) PCT Pub. No.: WO2013/080244

PCT Pub. Date: Jun. 6, 2013

(65) Prior Publication Data

US 2014/0290292 A1 Oct. 2, 2014

(51) Int. Cl.

*F25B 13/00* (2006.01)
*F25B 40/00* (2006.01)
*F25B 43/00* (2006.01)

(52) U.S. Cl.

CPC ..... *F25B 13/00* (2013.01); *F25B 40/00* (2013.01); *F25B 43/006* (2013.01); (Continued)

(58) Field of Classification Search

CPC ..... F25B 13/00; F25B 40/00; F25B 43/006; F25B 2600/2513; F25B 2500/28; F25B 2700/21152; F25B 2600/19

See application file for complete search history.

(56) References Cited

U.S. PATENT DOCUMENTS 3,264,837 A 8/1966 Harnish
5,669,231 A * 9/1997 Itoh ..... B60H 1/00907 62/210

(Continued)

FOREIGN PATENT DOCUMENTS

EP 1 647 783 A2 4/2006
JP 58-133574 A 8/1983

(Continued)

OTHER PUBLICATIONS

Extended European Search Report mailed Jul. 15, 2015 in the corresponding EP application No. 11876523.9 (and English translation).

(Continued)

*Primary Examiner* — Emmanuel Duke
(74) *Attorney, Agent, or Firm* — Posz Law Group, PLC

(57) ABSTRACT

A refrigerating and air-conditioning apparatus suppresses liquid backflow to a compressor with a simple configuration, and reduces annual power consumption.

An outdoor unit and an indoor unit are connected to each other by a gas-side connecting pipe and a liquid-side connecting pipe to form a refrigerant circuit in which a compressor, a four-way valve, an indoor heat exchanger, a refrigerant heat exchanger, an expansion valve, an outdoor heat exchanger, and an accumulator are sequentially connected. The refrigerant heat exchanger transfers heat between a high-pressure-side refrigerant flowing between the expansion valve and an outdoor-unit liquid pipe connecting portion and a low-pressure-side refrigerant on an outlet side of the accumulator.

5 Claims, 8 Drawing Sheets

(52) U.S. Cl.
CPC ..... *F25B 2500/28* (2013.01); *F25B 2600/19* (2013.01); *F25B 2600/2513* (2013.01); *F25B 2700/21152* (2013.01)

(56) References Cited

U.S. PATENT DOCUMENTS

| | | | | |
|---|---|---|---|---|
| 2002/0046570 | A1* | 4/2002 | Itoh | B60H 1/00907 62/324.1 |
| 2005/0039897 | A1 | 2/2005 | Muto et al. | |
| 2009/0013700 | A1* | 1/2009 | Unezaki | F25B 9/008 62/77 |
| 2010/0205987 | A1 | 8/2010 | Okazaki et al. | |
| 2010/0212342 | A1* | 8/2010 | Jeong | F25B 41/00 62/208 |

FOREIGN PATENT DOCUMENTS

| | | | |
|---|---|---|---|
| JP | 08-178450 | A | 7/1996 |
| JP | 2001-168564 | A | 6/2001 |
| JP | 2001-349623 | A | 12/2001 |
| JP | 2003-279170 | A | 10/2003 |
| JP | 2003279170 | A * | 10/2003 |
| JP | 2004-012127 | A | 1/2004 |
| JP | 2005-049026 | A | 2/2005 |
| JP | 2008-082653 | A | 4/2008 |
| JP | 2008-190773 | A | 8/2008 |
| JP | 2009-068736 | A | 4/2009 |
| JP | 2009-115385 | A | 5/2009 |
| JP | 2009-133547 | A | 6/2009 |
| WO | 2009-069524 | A1 | 4/2009 |

OTHER PUBLICATIONS

Office Action mailed Nov. 4, 2014 issued in corresponding JP patent application No. 2013-546830 (and English translation).
Office Action mailed Feb. 10, 2015 issued in corresponding JP patent application No. 2013-546830 (and English translation).
International Search Report of the International Searching Authority mailed Jan. 17, 2012 for the corresponding international application No. PCT/JP2011/006618 (and English translation).
Office Action mailed Apr. 28, 2015 in the corresponding CN application No. 201180075146.7 (and English translation).
Office Action issued Dec. 3, 2015 in the corresponding CN application No. 201180075146.7 (with English translation).
Office Action dated Feb. 13, 2017 issued in the corresponding EP application No. 11 876 523.9.

* cited by examiner (a)

(b)

(a)

(b)

REFRIGERATING AND AIR-CONDITIONING APPARATUS

CROSS REFERENCE TO RELATED APPLICATION

This application is a U.S. national stage application of PCT/JP2011/006618 filed on Nov. 29, 2011, the contents of which are incorporated herein by reference.

TECHNICAL FIELD

The present invention relates to a refrigerating and air-conditioning apparatus in which an outdoor unit which serves as a heat-source-side device and an indoor unit which serves as a load-side device separated from the outdoor unit are connected to each other by pipes.

BACKGROUND

In a refrigerating and air-conditioning apparatus of related art in which an outdoor unit and an indoor unit are separated and connected by pipes, the outdoor unit of related art includes a compressor, a four-way valve which serves as a flow switching device, an outdoor heat exchanger which serves as a heat-source-side heat exchanger, an expansion valve, an indoor heat exchanger which serves as a load-side heat exchanger, and an accumulator which serves as a refrigerant buffer vessel, which are connected to each other by pipes.

It is preferable that only a liquid refrigerant flow into the expansion valve. However, if, during cooling operation, a sufficient heat exchange quantity cannot be obtained in the outdoor heat exchanger or there is a high pressure loss is generated in pipes in the course of the operation, a refrigerant is in a two-phase state at an inlet of the expansion valve. This, for example, makes the control of the expansion valve unstable and causes refrigerant noise.

Most of the refrigerant gasified by the outdoor heat exchanger when the compressor is in operation during heating operation liquefies when the compressor is suspended. Therefore, a two-phase refrigerant flowing out of the outdoor heat exchanger when the heating operation is resumed is not completely separated into a gas and a liquid by the accumulator, and a liquid refrigerant is sucked into the compressor. This leads to degraded performance caused by a decrease in discharge temperature, degraded reliability caused by a decrease in concentration of oil in the compressor, and shortened life of the compressor caused by liquid compression.

As a means to solve the problems described above, there is a technique which provides a refrigerant heat exchanger configured to transfer heat between a pipe extending between an outdoor heat exchanger and an expansion valve and a pipe extending between an accumulator and a compressor (see, e.g., Patent Literature 1). In the technique disclosed in Patent Literature 1, during cooling operation, the refrigerant heat exchanger transfers heat from a high-temperature high-pressure refrigerant flowing out of the outdoor heat exchanger to a low-temperature low-pressure refrigerant flowing out of the accumulator, so as to cool the high-temperature high-pressure refrigerant. Thus, since the high-temperature high-pressure refrigerant flows as a completely liquid refrigerant into the expansion valve, the occurrence of refrigerant noise in the expansion valve can be reduced.

Also in the technique disclosed in Patent Literature 1, a bypass is provided which extends from a compressor discharge port to a compressor suction port, and an expansion valve in the bypass is opened when heating operation is resumed. Thus, part of a refrigerant discharged from the compressor passes through the bypass and is sucked through the suction port into the compressor. A liquid refrigerant sucked into the compressor without being fully separated by the accumulator is heated and gasified. It is thus possible to prevent liquid backflow from occurring when heating operation is resumed.

PATENT LITERATURE

Patent Literature 1: Japanese Unexamined Patent Application Publication No. 8-178450 (abstract)

In the technique disclosed in Patent Literature 1, where the refrigerant heat exchanger is provided, it is possible to solve the problem in which the refrigerant is in a two-phase state at the inlet of the expansion valve during cooling operation. However, the problem of liquid backflow from the accumulator during heating operation cannot be solved simply by providing the refrigerant heat exchanger, for the following reasons. That is, when the refrigerant heat exchanger is provided between the outdoor heat exchanger and the expansion valve, the outdoor heat exchanger serves as a condenser during cooling operation. Therefore, since there is a large temperature difference between the refrigerant flowing out of the condenser into the refrigerant heat exchanger and the refrigerant flowing out of the accumulator into the refrigerant heat exchanger, it is possible to obtain a sufficient heat exchange quantity in the refrigerant heat exchanger. This is effective in preventing liquid backflow.

However, during heating operation, where the refrigerant heat exchanger is located downstream of the expansion valve, the refrigerant heat exchanger transfers heat between the refrigerant reduced in pressure by the expansion valve and the refrigerant flowing out of the accumulator. Due to a small temperature difference between these refrigerants, the refrigerant flowing out of the accumulator cannot be sufficiently heated and the occurrence of liquid backflow cannot be prevented. Therefore, the technique disclosed in Patent Literature 1 requires a bypass separately. This makes the configuration complicated and leads to an increased cost.

If no bypass is provided in the technique disclosed in Patent Literature 1, a liquid refrigerant is sucked into the compressor during heating operation. This lowers the discharge temperature, and sufficient heat exchange cannot be performed by the indoor heat exchanger. Such a decrease in heat exchange quantity in the indoor heat exchanger leads to degraded performance during heating operation. Therefore, in an application, such as an air conditioner for home or shop use, where the performance during heating operation contributes more to annual power consumption than the performance during cooling operation does, the annual power consumption may increase.

In the technique disclosed in Patent Literature 1, the refrigerant heat exchanger operates effectively during cooling operation, but does not operate effectively during heating operation. Thus, since a sufficient amount of heating cannot be obtained in the refrigerant heat exchanger during heating operation, a two-phase gas-liquid refrigerant is sucked into the compressor. This may lead to decreased compressor reliability, and increased annual power consumption caused by degraded performance in heating operation.

SUMMARY

The present invention has been made in view of the problems described above, and has as its object to obtain a refrigerating and air-conditioning apparatus that can reduce liquid backflow to a compressor with a simple configuration, and can reduce annual power consumption.

A refrigerating and air-conditioning apparatus according to the present invention includes an outdoor unit having a compressor, a flow switching device, a refrigerant vessel, a heat-source-side heat exchanger, a pressure reducing device, and a refrigerant heat exchanger; and an indoor unit having a load-side heat exchanger. The outdoor unit and the indoor unit are connected to each other by a gas-side connecting pipe and a liquid-side connecting pipe to form a refrigerant circuit in which the compressor, the flow switching device, the load-side heat exchanger, the refrigerant heat exchanger, the pressure reducing device, the heat-source-side heat exchanger, and the refrigerant vessel are sequentially connected. The refrigerant heat exchanger transfers heat between a refrigerant flowing between the pressure reducing device and an outdoor-unit liquid pipe connecting portion which is a connecting portion of the liquid-side connecting pipe on the side of the outdoor unit and a refrigerant on the outlet side of the refrigerant vessel.

According to the present invention, it is possible, with a simple configuration, to obtain a sufficient heat exchange quantity in the refrigerant heat exchanger in both cooling and heating operations, and reduce liquid backflow to the compressor. Additionally, it is possible to obtain a sufficient heat exchange quantity in the indoor heat exchanger in heating operation, and reduce annual power consumption.

DETAILED DESCRIPTION

Embodiment 1

<General Configuration of Refrigerating and Air-Conditioning Apparatus>

Figure 1:
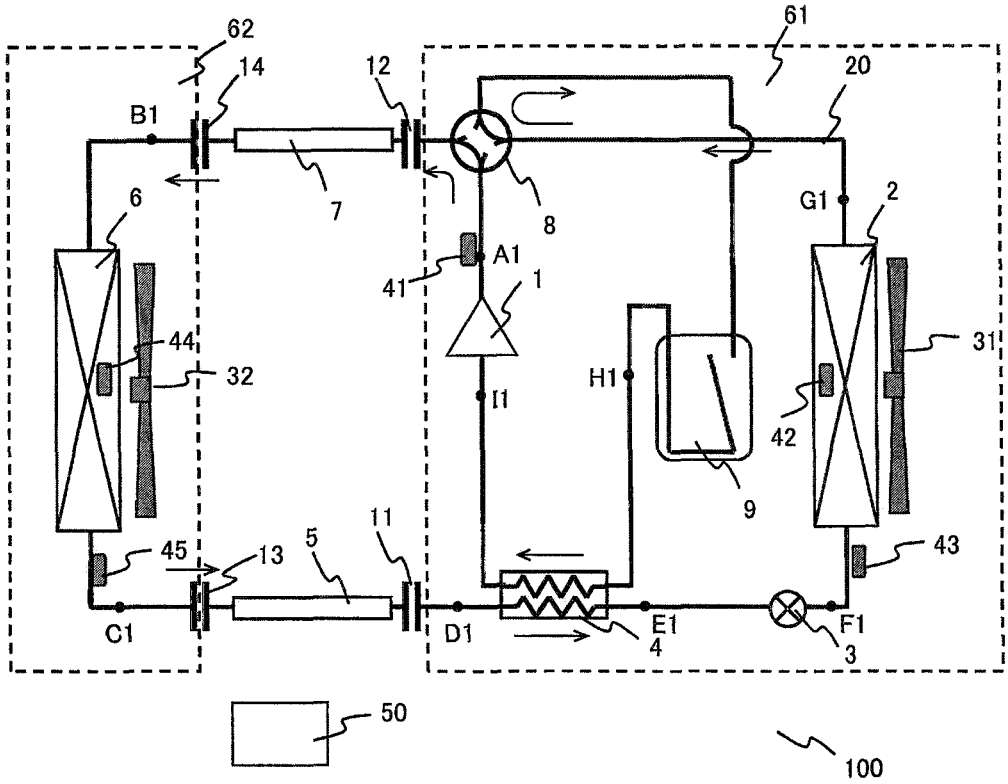
FIG. 1 illustrates the configuration of a refrigerating and air-conditioning apparatus according to Embodiment 1 of the present invention.

FIG. 1 illustrates the configuration of a refrigerating and air-conditioning apparatus according to Embodiment of the present invention. As illustrated in FIG. 1, a refrigerating and air-conditioning apparatus 100 includes an outdoor unit 61 and an indoor unit 62 separated from the outdoor unit 61. The outdoor unit 61 and the indoor unit 62 are connected to each other by a liquid pipe (liquid-side connecting pipe) 5 and a gas pipe (gas-side connecting pipe) 7 to form a refrigerant circuit 20 (to be described later). The outdoor unit 61 transfers heat to, or receives heat from, a heat source, such as the atmosphere. The indoor unit 62 transfers heat to, or receives heat from, a load, such as the indoor air. Although FIG. 1 illustrates a configuration that includes only one indoor unit 62, a plurality of indoor units may be provided.

<Configuration of Outdoor Unit>

The outdoor unit 61 includes a compressor 1, a four-way valve 8 which serves as a flow switching device, an outdoor heat exchanger (heat-source-side heat exchanger) 2 that exchanges heat with a heat-source-side medium, an accumulator 9 which serves as a refrigerant buffer vessel, an expansion valve 3 which serves as a pressure reducing device, and a refrigerant heat exchanger 4. These components of the outdoor unit 61 are connected to each other by a refrigerant pipe. The outdoor unit 61 further includes an outdoor fan 31 that conveys a heat-source-side medium, such as the atmosphere or water, to the outdoor heat exchanger 2. Each constituent device of the outdoor unit 61 will now be described sequentially.

(Compressor)

The compressor 1 is, for example, a fully-enclosed compressor. The rotation speed of the compressor 1 can be changed by an inverter in accordance with an instruction from a controller 50. By controlling the rotation speed of the compressor 1 to regulate the flow rate of the refrigerant circulating in the refrigerant circuit 20, the amount of heat transferred or received by the indoor unit 62 can be regulated and when, for example, the indoor air serves as a medium on the load side, an appropriate indoor air temperature can be maintained.

(Four-Way Valve)

The four-way valve 8 is used to switch the flow passage such that a gas refrigerant discharged from the compressor 1 flows into the outdoor heat exchanger 2 or the indoor heat exchanger 6. Switching the flow passage using the four-way valve 8 enables, for example, the outdoor heat exchanger 2 to function as a condenser (radiator) or an evaporator.

(Outdoor Heat Exchanger)

The outdoor heat exchanger 2 is, for example, a fin-and-tube type heat exchanger. The outdoor heat exchanger 2 transfers heat between a refrigerant and the outside air serving as a heat-source-side medium supplied from the outdoor fan 31. The heat-source-side medium that exchanges heat with the refrigerant in the outdoor heat exchanger 2 is not limited to the outside air (or air). For example, water or antifreeze may be used as a heat source. In this case, a plate heat exchanger is used as the outdoor heat exchanger 2, and a pump is used as a heat-source-side conveying device instead of the outdoor fan 31. A heat exchange pipe of the outdoor heat exchanger 2 may be buried in the ground to use geothermal heat, so that a heat source with stable temperatures can be supplied throughout the year.

(Expansion Valve)

For example, a solenoid valve having a variable opening degree is used as the expansion valve 3. By regulating the opening degree of the expansion valve 3 to minimize the condenser outlet supercooling degree or the evaporator outlet superheat degree, the refrigerant flow rate can be regulated for effective use of the outdoor heat exchanger 2 and the indoor heat exchanger 6. The refrigerant flow rate can also be regulated by arranging a plurality of fixed expansion devices, such as capillaries, in parallel.

(Accumulator)

The accumulator 9 has the capability of separating a two-phase refrigerant flowing out of the evaporator into a gas and a liquid. Therefore, by allowing the refrigerant to pass through the accumulator 9 before it flows into the compressor 1, the suction of a liquid refrigerant into the compressor 1 can be suppressed. The accumulator 9 thus contributes to improved reliability by, for example, preventing liquid compression in the compressor 1, and preventing shaft seizure caused by a decrease in concentration of oil in the compressor 1. At the same time, the accumulator 9 separates refrigerating machine oil that needs to be returned to the compressor 1. Therefore, a suction pipe (not shown) in the accumulator 9 is provided with a hole and a pipe for returning a necessary amount of refrigerating machine oil to the compressor 1, so that the refrigerating machine oil is returned to the compressor 1. When the refrigerating machine oil is dissolved in the refrigerant, a small amount of liquid refrigerant is returned to the compressor 1 together with the refrigerating machine oil.

(Refrigerant Heat Exchanger)

The refrigerant heat exchanger 4 is disposed between the expansion valve 3 and an outdoor-unit liquid pipe connecting portion 11 which is an outdoor-unit-side connecting portion of the liquid pipe 5. The refrigerant heat exchanger 4 transfers heat between a medium-temperature refrigerant flowing between the outdoor-unit liquid pipe connecting portion 11 and the expansion valve 3, and a refrigerant flowing between the accumulator 9 and the suction side of the compressor 1. By heat exchange in the refrigerant heat exchanger 4, a liquid refrigerant flowing out of the accumulator 9 can be gasified. When the refrigerant heat exchanger 4 has a double pipe structure, it is a common practice to guide a medium-temperature refrigerant to flow through an outer pipe, and a low-temperature refrigerant to flow through an inner pipe. Other examples of the refrigerant heat exchanger 4 may include a laminated plate heat exchanger. Of the refrigerants flowing through the refrigerant heat exchanger 4, a refrigerant flowing from the accumulator 9 into the refrigerant heat exchanger 4 will sometimes be referred to as a low-pressure-side refrigerant, and the other refrigerant will sometimes be referred to as a high-pressure-side refrigerant.

<Configuration of Indoor Unit>

The indoor unit 62 includes the indoor heat exchanger (load-side heat exchanger) 6 that exchanges heat with a load-side medium, and an indoor fan 32 that conveys the indoor air which serves as a load-side medium. Each constituent device of the indoor unit 62 will now be described sequentially.

(Indoor Heat Exchanger)

The indoor heat exchanger 6 is, for example, a fin-and-tube type heat exchanger, like the outdoor heat exchanger 2 described above. The indoor heat exchanger 6 transfers heat between a refrigerant and the indoor air serving as a load-side medium supplied from the indoor fan 32. The load-side medium that exchanges heat with the refrigerant in the indoor heat exchanger 6 is not limited to the indoor air. For example, water or antifreeze may be used as a heat source. In this case, a plate heat exchanger is used as the indoor heat exchanger 6, and a pump is used as a load-side conveying device instead of the indoor fan 32.

(Connecting Pipes)

The liquid pipe 5 and the gas pipe 7 are connecting pipes that connect the outdoor unit 61 and the indoor unit 62, and have a predetermined length necessary for the connection. Generally, the gas pipe 7 is greater in pipe diameter than the liquid pipe 5. The liquid pipe 5 is connected between the outdoor-unit liquid pipe connecting portion 11 of the outdoor unit 61 and an indoor-unit liquid pipe connecting portion 13 of the indoor unit 62. The gas pipe 7 is connected between an outdoor-unit gas pipe connecting portion 12 of the outdoor unit 61 and an indoor-unit gas pipe connecting portion 14 of the indoor unit 62. By connecting the outdoor unit 61 and the indoor unit 62 via the liquid pipe 5 and the gas pipe 7, the refrigerant circuit 20 is formed in which a refrigerant circulates through the compressor 1, the four-way valve 8, the indoor heat exchanger 6, the high-pressure side of the refrigerant heat exchanger 4, the expansion valve 3, the outdoor heat exchanger 2, the four-way valve 8, the accumulator 9, and the low-pressure side of the refrigerant heat exchanger 4 in this order.

<Sensors and Controller>

Sensors and the controller 50 included in the refrigerating and air-conditioning apparatus 100 will now be described.

In the outdoor unit 61, the compressor 1 is provided with a discharge temperature sensor 41 on a discharge side thereof. The discharge temperature sensor 41 serves as a discharge temperature detecting device that detects the temperature of a refrigerant discharged from the compressor 1 (to be referred to as the discharge temperature hereinafter). The outdoor heat exchanger 2 is provided with an outdoor-heat-exchanger saturation temperature sensor 42 that detects the temperature of a refrigerant flowing through the outdoor heat exchanger 2 (i.e., a refrigerant temperature corresponding to a condensing temperature during cooling operation or an evaporating temperature during heating operation). An outdoor-heat-exchanger temperature sensor 43 that detects the temperature of a refrigerant is provided on the liquid side of the outdoor heat exchanger 2.

The outdoor heat exchanger 2 serves as a condenser (radiator) during cooling operation. A condenser outlet supercooling degree during cooling operation can be determined by subtracting the value detected by the outdoor-heat-exchanger saturation temperature sensor 42 from the value detected by the outdoor-heat-exchanger temperature sensor 43. Thus, the outdoor-heat-exchanger saturation temperature sensor 42 and the outdoor-heat-exchanger temperature sensor 43 form a supercooling degree detecting device. The configuration of the supercooling degree detecting device is not limited to this. A sensor that detects the discharge pressure of the refrigerant discharged from the compressor 1 may be provided, so that the condenser outlet supercooling degree during cooling operation is determined by subtracting, from the value detected by the outdoor-heat-exchanger temperature sensor 43, a refrigerant saturated gas temperature that can be converted from the value detected by this sensor.

In the indoor unit 62, the indoor heat exchanger 6 is provided with an indoor-heat-exchanger saturation temperature sensor 44 that detects the temperature of a refrigerant flowing through the indoor heat exchanger 6 (i.e., a refrigerant temperature corresponding to an evaporating temperature during cooling operation or a condensing temperature during heating operation). An indoor-heat-exchanger temperature sensor 45 that detects the temperature of a refrigerant is provided on the liquid side of the indoor heat exchanger 6.

The indoor heat exchanger 6 serves as a condenser (radiator) during heating operation. A condenser outlet supercooling degree during heating operation can be determined by subtracting the value detected by the indoor-heat-exchanger saturation temperature sensor 44 from the value detected by the indoor-heat-exchanger temperature sensor 45. Thus, the indoor-heat-exchanger saturation temperature sensor 44 and the indoor-heat-exchanger temperature sensor 45 form a supercooling degree detecting device. The configuration of the supercooling degree detecting device is not limited to this. A sensor that detects the discharge pressure of the refrigerant discharged from the compressor 1 may be provided, so that the condenser outlet supercooling degree during heating operation is determined by subtracting, from the value detected by the indoor-heat-exchanger temperature sensor 45, a refrigerant saturated gas temperature that can be converted from the value detected by this sensor.

The controller 50 is implemented by a microcomputer and includes, for example, a CPU, a RAM, and a ROM. The ROM stores, for example, a control program and a program corresponding to a flowchart (to be described later). The controller 50 controls the compressor 1, the expansion valve 3, the outdoor fan 31, and the indoor fan 32 on the basis of the value detected by each sensor. The controller 50 performs cooling operation or heating operation by switching the four-way valve 8. The controller 50 may be included in the outdoor unit 61 or the indoor unit 62, or may be composed of an indoor control unit and an outdoor control unit which operate in cooperation with each other.

The heating operation and the cooling operation in the refrigerant circuit 20 according to Embodiment 1 will now be described sequentially.

<Action of Refrigerant in Heating Operation>

Figure 2:
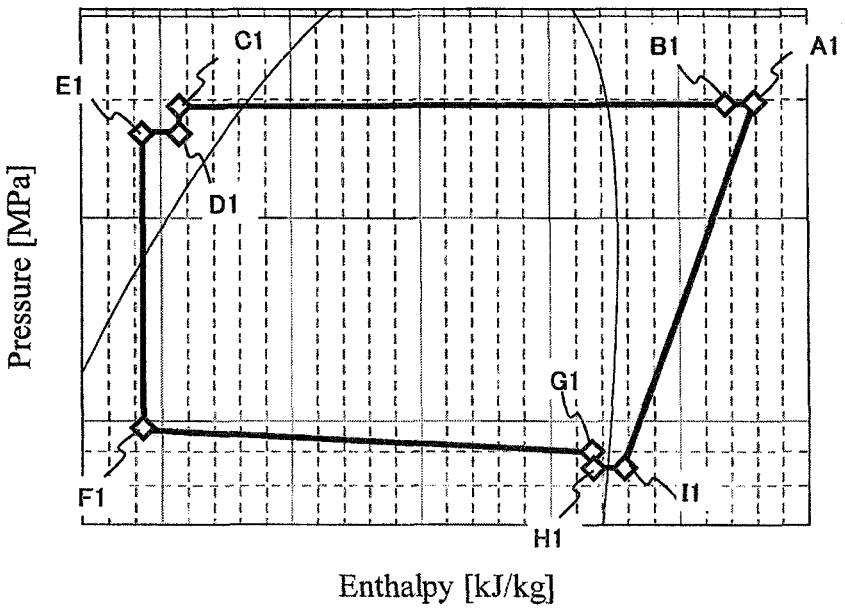
FIG. 2 is a p-h diagram showing the relationship between enthalpy and pressure during heating operation of the refrigerating and air-conditioning apparatus illustrated in FIG. 1.

FIG. 2 is a p-h diagram showing the relationship between enthalpy and pressure during heating operation in the refrigerating and air-conditioning apparatus illustrated in FIG. 1. The horizontal axis represents the enthalpy [kJ/kg], and the vertical axis represents the pressure [Mpa]. Refrigerant states indicated by points A1 to I1 in FIG. 2 correspond to respective refrigerant states at points A1 to I1 in the refrigerating and air-conditioning apparatus according to Embodiment 1 illustrated in FIG. 1. Each arrow in FIG. 1 indicates a current of refrigerant during heating operation.

In heating operation, the four-way valve 8 is in a state indicated by a solid line in FIG. 1. A high-temperature high-pressure refrigerant (A1) discharged from the compressor 1 passes through the four-way valve 8 and flows through the outdoor-unit gas pipe connecting portion 12 into the gas pipe 7. Since the gas pipe 7 has a predetermined length, the refrigerant flowing into the gas pipe 7 is reduced in pressure by friction loss in the gas pipe 7. Then, the refrigerant flows through the indoor-unit gas pipe connecting portion 14 into the indoor unit 62 and changes to a state (B1). The refrigerant in the state (B1) flows into the indoor heat exchanger 6. The indoor heat exchanger 6 functions as a radiator during heating operation. Therefore, the refrigerant flowing into the indoor heat exchanger 6 exchanges heat with the indoor air from the indoor fan 32 to transfer the heat, has its temperature lowered, turns into a liquid refrigerant (C1) generally in a supercooled state, and flows out of the indoor heat exchanger 6.

The liquid refrigerant flowing out of the indoor heat exchanger 6 flows through the indoor-unit liquid pipe connecting portion 13 into the liquid pipe 5. As in the refrigerant which passes through the gas pipe 7, the refrigerant which passes through the liquid pipe 5 is reduced in pressure by friction loss, and flows through the outdoor-unit liquid pipe connecting portion 11 into the outdoor unit 61. The refrigerant (D1) flowing into the outdoor unit 61 is used by the refrigerant heat exchanger 4 to exchange heat with a refrigerant from the accumulator 9, and is further cooled and changes to a state (E1). After being cooled in the refrigerant heat exchanger 4, the refrigerant in the state (E1) is reduced in pressure by the expansion valve 3. Then, the refrigerant turns into a two-phase gas-liquid refrigerant (F1) and flows into the outdoor heat exchanger 2. Since the outdoor heat exchanger 2 functions as an evaporator during heating operation, the refrigerant flowing into the outdoor heat exchanger 2 exchanges heat with the outdoor air from the outdoor fan 31 to receive the heat, evaporates, turns into a saturated gas or a two-phase refrigerant (G1) having a high quality of vapor, and flows out of the outdoor heat exchanger 2.

The refrigerant (G1) flowing out of the outdoor heat exchanger 2 passes through the four-way valve 8 and flows into the accumulator 9. The refrigerant flowing into the accumulator 9 in a two-phase gas-liquid state is separated into a gas and a liquid by the accumulator 9. However, because a liquid refrigerant is sucked in together with refrigerating machine oil through an oil return hole (not shown) of the accumulator 9, a two-phase gas-liquid refrigerant (H1) having a high quality of vapor flows out of the accumulator 9. After flowing out of the accumulator 9, the two-phase gas-liquid refrigerant (H1) having a low temperature flows into the refrigerant heat exchanger 4, exchanges heat with a refrigerant flowing between the outdoor-unit liquid pipe connecting portion 11 and the expansion valve 3 to receive the heat, evaporates, turns into a gas refrigerant (I1), and is sucked into the compressor 1.

<Reason for Performing Heat Exchange in Refrigerant Heat Exchanger 4 in Heating Operation>

The reason for performing heat exchange in the refrigerant heat exchanger 4 in heating operation will be described next. The refrigerant heat exchanger 4 performs heat exchange using the temperature difference between the low-pressure low-temperature refrigerant (H1) flowing out of the accumulator 9 and the high-pressure medium-temperature refrigerant (D1) flowing between the outdoor-unit liquid pipe connecting portion 11 and the expansion valve 3. For example, when the refrigerant temperature of the high-pressure refrigerant (D1) flowing into the refrigerant heat exchanger 4 is 25° C. and the refrigerant temperature of the low-pressure refrigerant (H1) is 0° C., these refrigerants have a temperature difference of 25° C. Thus, the low-pressure two-phase refrigerant flowing out of the accumulator 9 is heated and gasified by exchanging heat with a refrigerant having a temperature higher than its own temperature by 25° C.

<Action of Refrigerant in Cooling Operation>

Figure 3:
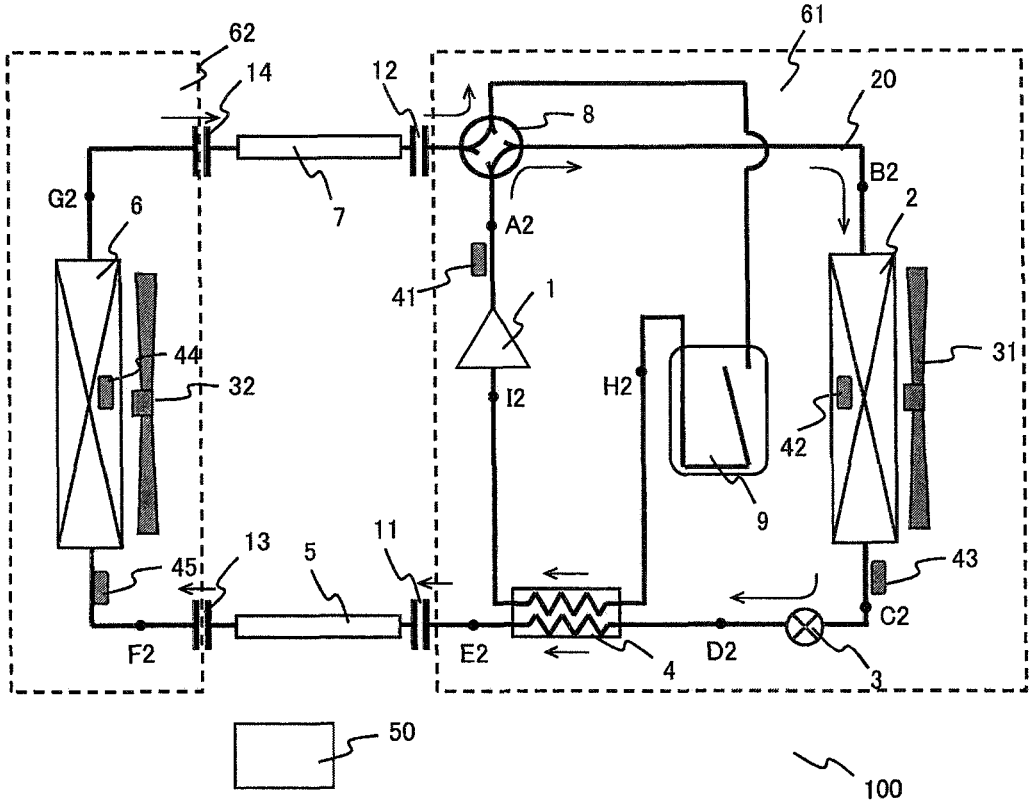
FIG. 3 illustrates a flow of refrigerant during cooling operation of the refrigerating and air-conditioning apparatus illustrated in FIG. 1.
Figure 4:
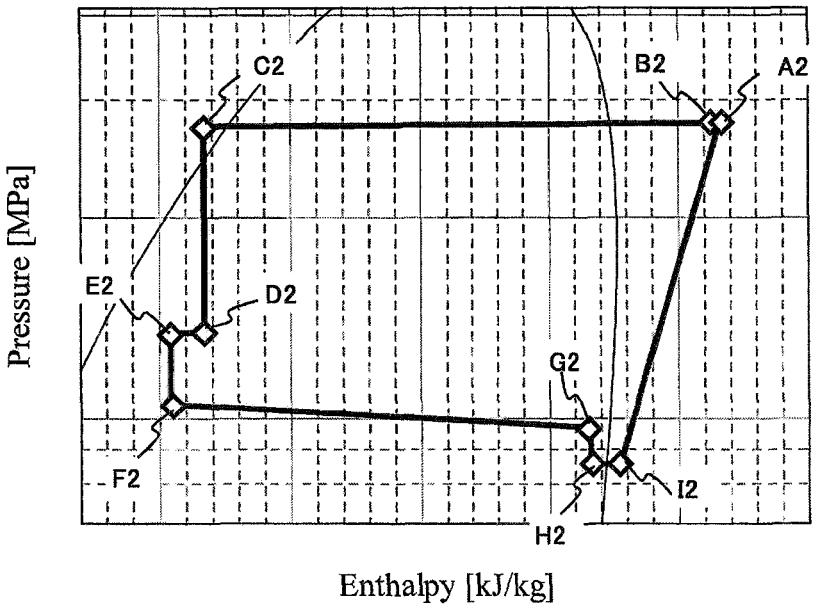
FIG. 4 is a p-h diagram showing the relationship between enthalpy and pressure during cooling operation illustrated in FIG. 3.

FIG. 3 illustrates a flow of refrigerant during cooling operation of the refrigerating and air-conditioning apparatus illustrated in FIG. 1. FIG. 4 is a p-h diagram showing the relationship between enthalpy and pressure during the cooling operation illustrated in FIG. 3. The horizontal axis represents the enthalpy [kJ/kg], and the vertical axis represents the pressure [Mpa]. Refrigerant states indicated by points A2 to I2 in FIG. 4 correspond to respective refrigerant states at points A2 to I2 illustrated in FIG. 3.

In cooling operation, the four-way valve 8 is in a state indicated by a solid line in FIG. 3. A high-temperature high-pressure refrigerant (A2) discharged from the compressor 1 passes through the four-way valve 8 and flows into the outdoor heat exchanger 2. The refrigerant (B2) flowing into the outdoor heat exchanger 2 is in substantially the same refrigerant state as the high-temperature high-pressure refrigerant (A2) discharged from the compressor 1. The outdoor heat exchanger 2 functions as a radiator during cooling operation. Therefore, the refrigerant flowing into the outdoor heat exchanger 2 exchanges heat with the outside air (atmosphere) from the outdoor fan 31 to transfer the heat, has its temperature lowered, turns into a liquid refrigerant (C2) generally in a supercooled state, and flows out of the outdoor heat exchanger 2.

The refrigerant flowing out of the outdoor heat exchanger 2 is reduced in pressure by the expansion valve 3, turns into a two-phase gas-liquid refrigerant (D2), and flows into the refrigerant heat exchanger 4. After flowing into the refrigerant heat exchanger 4, the two-phase gas-liquid refrigerant is cooled by exchanging heat with a refrigerant from the accumulator 9, changes to a state (E2), and flows out of the refrigerant heat exchanger 4. After flowing out of the refrigerant heat exchanger 4, the refrigerant in the state (E2) passes through the outdoor-unit liquid pipe connecting portion 11 and flows into the liquid pipe 5. Since the liquid pipe 5 has a predetermined length, the refrigerant flowing into the liquid pipe 5 is further reduced in pressure by friction loss in the liquid pipe 5. Then, the refrigerant flows through the indoor-unit liquid pipe connecting portion 13 into the indoor unit 62 and changes to a state (F2). The refrigerant in the state (F2) flows into the indoor heat exchanger 6. The indoor heat exchanger 6 functions as an evaporator during cooling operation. Therefore, the refrigerant (F2) flowing into the indoor heat exchanger 6 exchanges heat with the indoor air from the indoor fan 32 to receive the heat, evaporates, turns into a saturated gas or a two-phase refrigerant (G2) having a high quality of vapor, and flows out of the indoor heat exchanger 6.

The refrigerant (G2) flowing out of the indoor heat exchanger 6 passes through the indoor-unit gas pipe connecting portion 14 and flows into the gas pipe 7. The gas pipe 7 has the same length as the liquid pipe 5. The refrigerant flowing into the gas pipe 7 is reduced in pressure by friction loss while passing through the gas pipe 7. Then, the refrigerant passes through the outdoor-unit gas pipe connecting portion 12 and the four-way valve 8, and flows into the accumulator 9. The refrigerant flowing into the accumulator 9 in a two-phase gas-liquid state is separated into a gas and a liquid by the accumulator 9. However, because a liquid refrigerant is sucked in together with refrigerating machine oil through the oil return hole of the accumulator 9, a two-phase gas-liquid refrigerant (H2) having a high quality of vapor flows out of the accumulator 9. After flowing out of the accumulator 9, the two-phase gas-liquid refrigerant (H2) having a low temperature flows into the refrigerant heat exchanger 4, exchanges heat with a refrigerant flowing between the expansion valve 3 and the outdoor-unit liquid pipe connecting portion 11 to receive the heat, evaporates, turns into a gas refrigerant (I2), and is sucked into the compressor 1.

<Reason for Performing Heat Exchange in Refrigerant Heat Exchanger in Cooling Operation>

The reason for performing heat exchange in the refrigerant heat exchanger 4 in cooling operation will be described next. The refrigerant heat exchanger 4 performs heat exchange using the temperature difference between the low-pressure low-temperature refrigerant (H2) flowing out of the accumulator 9 and the medium-pressure medium-temperature refrigerant (D2) flowing between the outdoor-unit liquid pipe connecting portion 11 and the expansion valve 3. The refrigerant flowing from the outdoor heat exchanger 2 which serves as a condenser toward the refrigerant heat exchanger 4 is reduced in pressure (reduced in temperature) by the expansion valve 3 disposed upstream of the refrigerant heat exchanger 4, and flows into the refrigerant heat exchanger 4. The pressure of the refrigerant is reduced more in this case than in heating operation during which the refrigerant from the condenser directly flows into the refrigerant heat exchanger 4. Therefore, the temperature difference in the refrigerant heat exchanger 4 is not as large as that in heating operation.

However, the refrigerant (E2) flowing out of the refrigerant heat exchanger 4 and passing through the outdoor-unit liquid pipe connecting portion 11 toward the indoor unit 62 is further reduced in pressure, by friction loss, while passing through components arranged downstream of the outdoor-unit liquid pipe connecting portion 11, that is, through the liquid pipe 5, the indoor heat exchanger 6, the gas pipe 7, etc. Thus, as is obvious from FIG. 4, the refrigerant (D2) that has been reduced in pressure by the expansion valve 3 is higher in pressure than the refrigerant (H2) flowing out of the accumulator 9 and into the refrigerant heat exchanger 4. Therefore, the refrigerant heat exchanger 4 can ensure a temperature difference with which the refrigerant from the accumulator 9 can be heated and gasified. For example, when the refrigerant temperature of the refrigerant (D2) that has been reduced in pressure by the expansion valve 3 is 25° C. and the refrigerant temperature of the refrigerant (H2) flowing out of the accumulator 9 is 5° C., these refrigerants have a temperature difference of 20° C. Therefore, the two-phase gas-liquid refrigerant flowing out of the accumulator 9 can be gasified.

(Design of Refrigerant Heat Exchanger 4)

Design of the refrigerant heat exchanger 4 for preventing liquid backflow to the compressor 1 and excess heat exchange in the refrigerant heat exchanger 4 will now be described.

The relationship among the performance of the refrigerant heat exchanger 4 necessary for gasifying the refrigerant flowing out of the accumulator 9, an inlet temperature TM of a high-pressure-side refrigerant in the refrigerant heat exchanger 4, and an inlet temperature TL of a low-pressure-side refrigerant in the refrigerant heat exchanger 4 will be described first. A heat exchange quantity Qslhx in the refrigerant heat exchanger 4 can be expressed by expression (1) as a function of a heat conductance AK (the product of a heat transfer area A and a heat transmission coefficient K) and a refrigerant temperature difference ΔT (=TM−TL).

[Expression 1]

$$Qslhx = AK \times (TM - TL) \quad (1)$$

The heat exchange quantity Qslhx in the refrigerant heat exchanger 4 can also be expressed by expression (2) as a function of a refrigerant flow rate Gr on the low-pressure side of the refrigerant heat exchanger 4 and an inlet-outlet enthalpy difference ΔH (=H(I)−H(H)) on the low-pressure side of the refrigerant heat exchanger 4. Note that H(H) is the low-pressure-side inlet enthalpy and H(I) is the low-pressure-side outlet enthalpy.

[Expression 2]

$$Qsllx = Gr \times (H(I) - H(H)) \quad (2)$$

From expressions (1) and (2) described above, the relationship among the heat conductance AK, the refrigerant temperature difference ΔT (=TM−TL), the refrigerant flow rate Gr, and the inlet-outlet enthalpy difference ΔH (=H(I)−H(H)) on the low-pressure side of the refrigerant heat exchanger 4 can be expressed by expression (3).

[Expression 3]

$$\frac{AK}{Gr} = \frac{H(I) - H(H)}{TM - TL} \quad (3)$$

The separation efficiency of the accumulator 9 is ideally 100%, but is less than 100% in practice. Assume here that the separation efficiency of the accumulator 9 is 99.9%. The separation efficiency of the accumulator 9 is generally set to 90% or above regardless of the type of refrigerant. The quality of vapor of the refrigerant at the low-pressure-side inlet of the refrigerant heat exchanger 4 is 0.9 to 0.999 if it is substantially equivalent to the separation efficiency of the accumulator 9. Since the quality of vapor is thus determined, the enthalpy H(H) of the refrigerant at the low-pressure-side inlet of the refrigerant heat exchanger 4 is, in turn, determined.

The role required of the refrigerant heat exchanger 4 is to suppress liquid backflow to the compressor 1. Therefore, although the refrigerant sucked into the compressor 1 is a saturated gas in an ideal state, the refrigerant is a superheated gas under actual control. Thus, the target value of the state of the refrigerant at the low-pressure-side outlet of the refrigerant heat exchanger 4 is set to fall within the range of a saturated gas (a degree of superheat of 0 K) to a degree of superheat of 5 K. Since the range of the target state of the refrigerant at the low-pressure-side outlet is thus determined, the range of the enthalpy H(I) of the refrigerant at the low-pressure-side outlet of the refrigerant heat exchanger 4 can also be determined.

The range of the enthalpy H(H) of the refrigerant at the low-pressure-side inlet and the range of the enthalpy H(I) of the refrigerant at the low-pressure-side outlet are determined as described above. Thus, from expression (3) and FIG. 5, the relationship between the refrigerant temperature difference ΔT (=TM−TL) and the ratio of AK to Gr (AK/Gr) can be expressed by expression (4).

Figure 5:
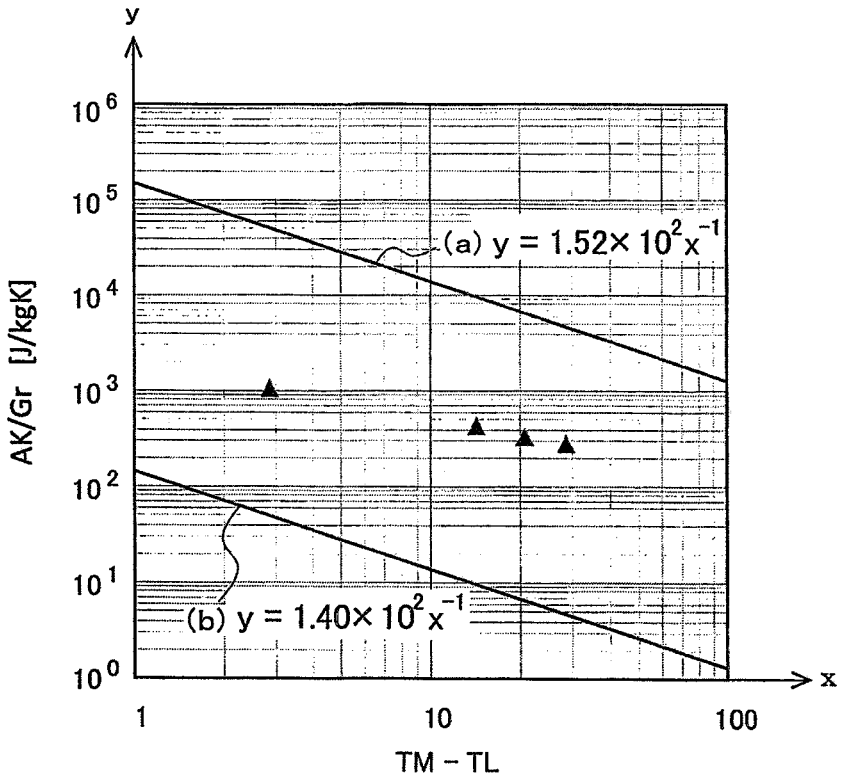
FIG. 5 shows the relationship between the refrigerant temperature difference and the heat exchanger performance.

FIG. 5 shows the relationship between the refrigerant temperature difference and the heat exchanger performance. Referring to FIG. 5, the horizontal axis represents the refrigerant temperature difference ΔT (=TM−TL) and the vertical axis represents AK/Gr. Four plotted points shown in FIG. 5 indicate the case where R410A is used and the degree of superheat is set to 0 K to 4 K. Referring again to FIG. 5, (a) shows an approximate expression indicating a maximum value (corresponding to a degree of superheat of 0 K) in each of various other refrigerants (e.g., hydrocarbon refrigerants, such as R134a, R1234yf, and propane, or a mixture thereof) used in the refrigerating and air-conditioning apparatus 100, and (b) shows an approximate expression indicating a minimum value (corresponding to a degree of superheat of 5 K) in each of the same refrigerants as those in (a).

[Expression 4]

$$\frac{1.40 \times 10^2}{TM - TL} \leqq \frac{AK}{Gr} \leqq \frac{1.52 \times 10^5}{TM - TL} \quad (4)$$

By designing the refrigerant heat exchanger 4 to satisfy the range described above, it is possible to eliminate the inconvenience of liquid backflow to the compressor 1 caused by shortage of heat exchange quantity in the refrigerant heat exchanger 4. It is also possible to eliminate the inconvenience where, for example, the degree of suction superheat is increased by an excess heat exchange quantity in the refrigerant heat exchanger 4 and the discharge temperature increases in excess of a certain threshold.

<Reason for Performing Discharge Temperature Control>

Generally, a refrigerating and air-conditioning apparatus controls the opening degree of the expansion valve 3 such that the discharge temperature detected by a discharge temperature sensor maximizes the operating efficiency (to be referred to as COP hereinafter). One reason for using the discharge temperature as a controlled object is that, because a discharged refrigerant is in a gas state, the discharged refrigerant is smaller in specific heat than a liquid refrigerant and responds more quickly to the opening degree control of the expansion valve 3. Because of the quick response, controlling the opening degree of the expansion valve 3 can quickly control the discharge temperature to a point that maximizes COP. Another reason for using the discharge temperature as a controlled object is that even if the discharge temperature increases in excess of a certain threshold, protective control can be performed quickly.

<Relationship 1 Among Discharge Temperature, Condenser Outlet Supercooling Degree, and COP>

Figure 6:
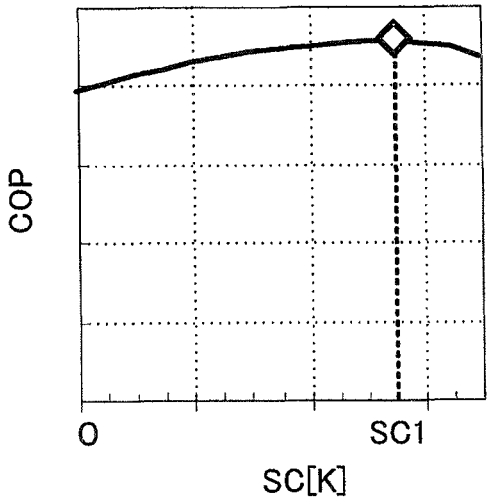
FIG. 6 shows a relationship (1) between the condenser outlet supercooling degree and each of COP and the discharge temperature according to Embodiment 1 of the present invention.
Figure 6:
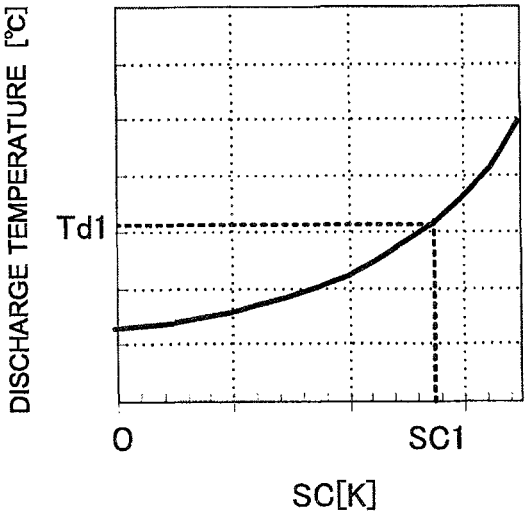

FIG. 6(*a*) shows the relationship between the condenser outlet supercooling degree SC and COP under a given operating condition in the refrigerating and air-conditioning apparatus illustrated in FIG. 1. FIG. 6(*b*) shows the relationship between the condenser outlet supercooling degree SC and the discharge temperature under the same operating condition as that in FIG. 6(*a*). Referring to FIG. 6(*a*), the horizontal axis represents SC [K], and the vertical axis represents COP. Referring to FIG. 6(*b*), the horizontal axis represents SC [K], and the vertical axis represents the discharge temperature [° C.].

As shown in FIG. 6(*a*), the refrigerating and air-conditioning apparatus 100 has a condenser outlet supercooling degree SC at which COP is maximum. In the example of FIG. 6(*a*), COP is maximum when the condenser outlet supercooling degree SC is SC1. Therefore, SC1 is set as a target supercooling degree. Since a discharge temperature is uniquely determined upon determining the condenser outlet supercooling degree SC, a discharge temperature Td1 corresponding to the target supercooling degree SC1 is selected as a target discharge temperature. By controlling the expansion valve 3 such that the discharge temperature reaches the target discharge temperature Td1, the condenser outlet supercooling degree SC can reach the target supercooling degree SC1 and operation can be performed with maximum COP.

<Relationship 2 Among Discharge Temperature, Condenser Outlet Supercooling Degree, and COP>

Figure 7:
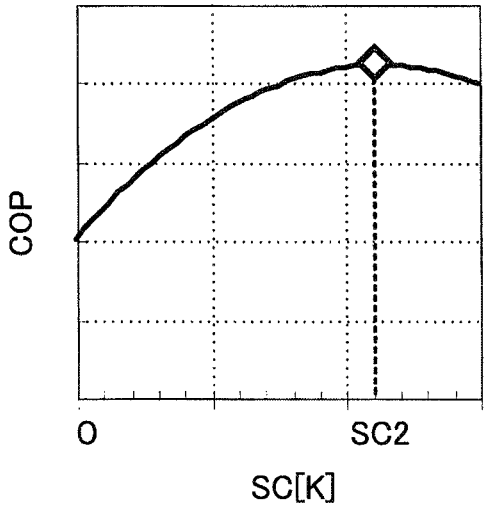
FIG. 7 shows a relationship (2) between the condenser outlet supercooling degree and each of COP and the discharge temperature according to Embodiment 1 of the present invention.
Figure 7:
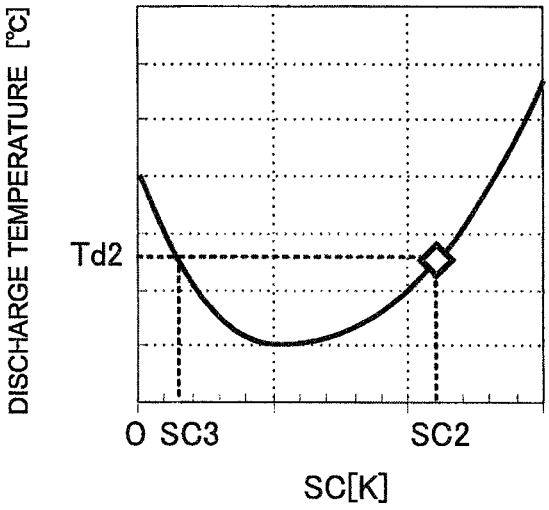

FIG. 7(*a*) shows the relationship between the condenser outlet supercooling degree SC and COP under an operating condition different from that in FIG. 6 in the refrigerating and air-conditioning apparatus illustrated in FIG. 1. FIG. 7(*b*) shows the relationship between the condenser outlet supercooling degree SC and the discharge temperature under the same operating condition as that in FIG. 7(*a*). Referring to FIG. 7(*a*), the horizontal axis represents SC [K], and the vertical axis represents COP. Referring to FIG. 7(*b*), the horizontal axis represents SC [K], and the vertical axis represents the discharge temperature [° C.].

Under the operating condition of FIG. 7, COP is maximum when the condenser outlet supercooling degree is SC2. The discharge temperature at which the condenser outlet supercooling degree SC becomes SC2 is Td2. However, as is obvious from FIG. 7(*b*), the discharge temperature is Td2 not only at SC2 but also at SC3. Therefore, even if Td2 is set as a target discharge temperature to control the expansion valve 3, the condenser outlet supercooling degree SC cannot necessarily become SC2 and operation cannot necessarily be performed with maximum COP.

As described above, since two states defining different condenser outlet supercooling degrees SC for the same discharge temperature are possible depending on the operating condition, expansion valve control cannot be performed simply by using the discharge temperature alone. Therefore, in Embodiment 1, the condenser outlet supercooling degree SC as well as the discharge temperature is taken into account to perform expansion valve control.

A principle of expansion valve control according to Embodiment 1 will now be described.

Figure 8:
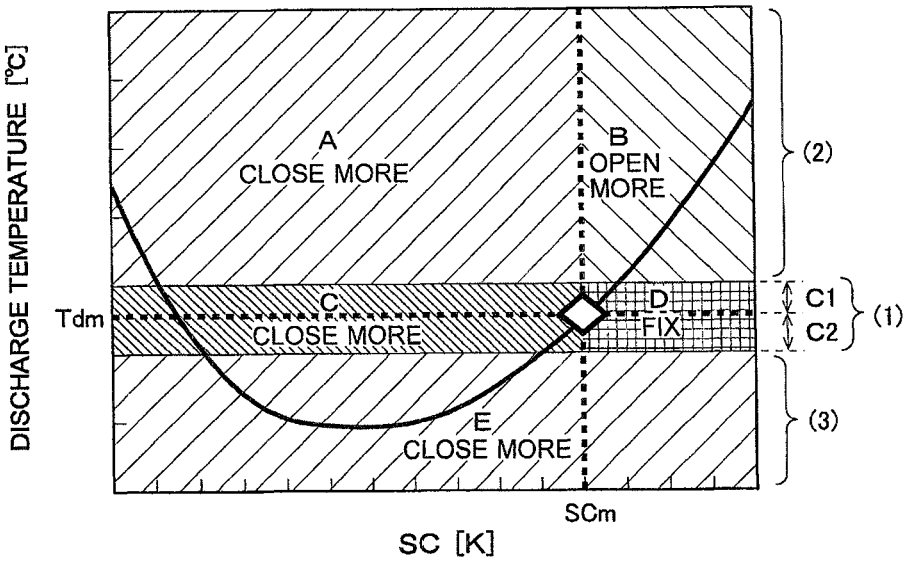
FIG. 8 illustrates expansion valve control according to Embodiment 1 of the present invention.
Figure 9:
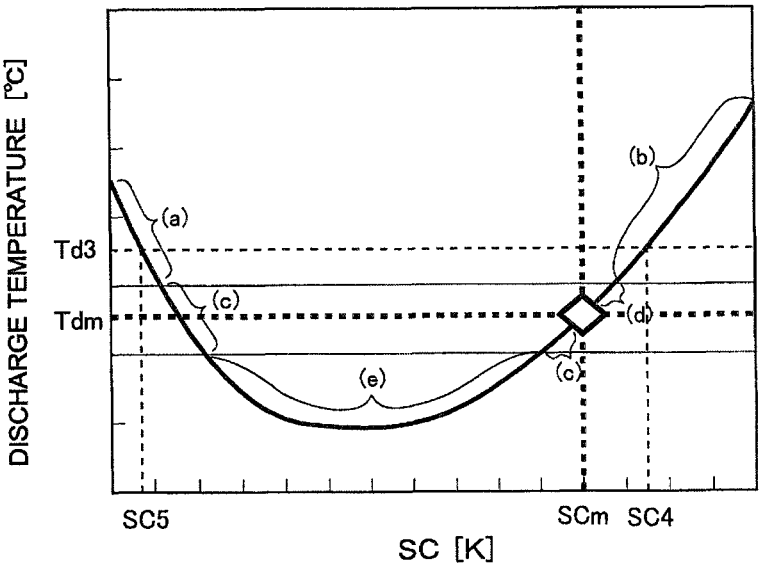
FIG. 9 shows each section of a supercooling degree SC-discharge temperature characteristic divided in accordance with regions shown in FIG. 8.

FIG. 8 illustrates expansion valve control according to Embodiment 1 of the present invention. FIG. 8 shows the relationship between the condenser outlet supercooling degree SC and the discharge temperature under a given operating condition. Referring to FIG. 8, the horizontal axis represents SC [K] and the vertical axis represents COP. Referring again to FIG. 8, "close more", "open more", and "fix" indicate how the opening degree of the expansion valve 3 is controlled. FIG. 9 shows each section of an SC-discharge temperature characteristic divided in accordance with regions shown in FIG. 8. Referring to FIG. 9, (a) to (e) indicate sections of the SC-discharge temperature characteristic divided in accordance with regions shown in FIG. 8, and correspond to A to E in FIG. 8. That is, (a) in FIG. 9 corresponds to region A in FIG. 8, (b) in FIG. 9 corresponds to region B in FIG. 8, etc.

How the five regions A to E in FIG. 8 are defined will be described next. A discharge temperature range is divided into a range (1) including a target discharge temperature Tdm (first discharge temperature range), a range (2) in which the discharge temperature is higher than that in the range (1) (second discharge temperature range), and a range (3) in which the discharge temperature is lower than that in the range (1) (third discharge temperature range). Of the three ranges, the ranges (1) and (2) are each divided into two parts with respect to a target condenser outlet supercooling degree (to be referred to as a target supercooling degree hereinafter) SCm to obtain a total of five regions. A predetermined value C1 (e.g., C1=2) and a predetermined value C2 (e.g., C2=−2) are used to provide certain ranges to the target discharge temperature Tdm and the target supercooling degree SCm, and can be freely set and changed by users.

In accordance with the current operating state, that is, in accordance with to which of regions A to E the current discharge temperature and the current condenser outlet supercooling degree belong, the opening degree of the expansion valve 3 is controlled to (close more), (open more), or (fix) indicated by the region of interest.

When the current operating state belongs to region A, region C, or region E in FIG. 8, the expansion valve 3 is controlled to be closed more. That is, in any of the ranges (a), (c), and (e) in FIG. 9, the current condenser outlet supercooling degree SC is smaller than the target supercooling degree SCm. Therefore, control is performed to close the expansion valve 3 more so as to increase the condenser outlet supercooling degree SC and thereby bring it closer to the target supercooling degree SCm.

When the current operating state belongs to region B in FIG. 8, the expansion valve 3 is controlled to be opened more. That is, in the range (b) in FIG. 9, the current condenser outlet supercooling degree SC is greater than the target supercooling degree SCm. Therefore, control is performed to open the expansion valve 3 more so as to decrease the condenser outlet supercooling degree SC and thereby bring it closer to the target supercooling degree SCm.

When the current operating state belongs to region D in FIG. 8, the opening degree of the expansion valve 3 is left unchanged (fixed). That is, in the range (d) in FIG. 9, the current discharge temperature is determined to be equal to or close to the target discharge temperature, and the current opening degree of the expansion valve 3 is maintained.

Under the expansion valve control described above, for example, when the discharge temperature detected by the discharge temperature sensor 41 is Td3 (FIG. 9), the condenser outlet supercooling degree SC can be made equal to the target supercooling degree SCm, regardless of whether the current condenser outlet supercooling degree SC determined from the values detected by the outdoor-heat-exchanger temperature sensor 43 and the outdoor-heat-exchanger saturation temperature sensor 42 is SC4 or SC5. Thus, operation can be performed with maximum COP.

A concrete specific control flow based on the expansion valve control principle described above will be described next.

<Concrete Control Method: Changing Control in Accordance with Steady or Unsteady Condition>

Figure 10:
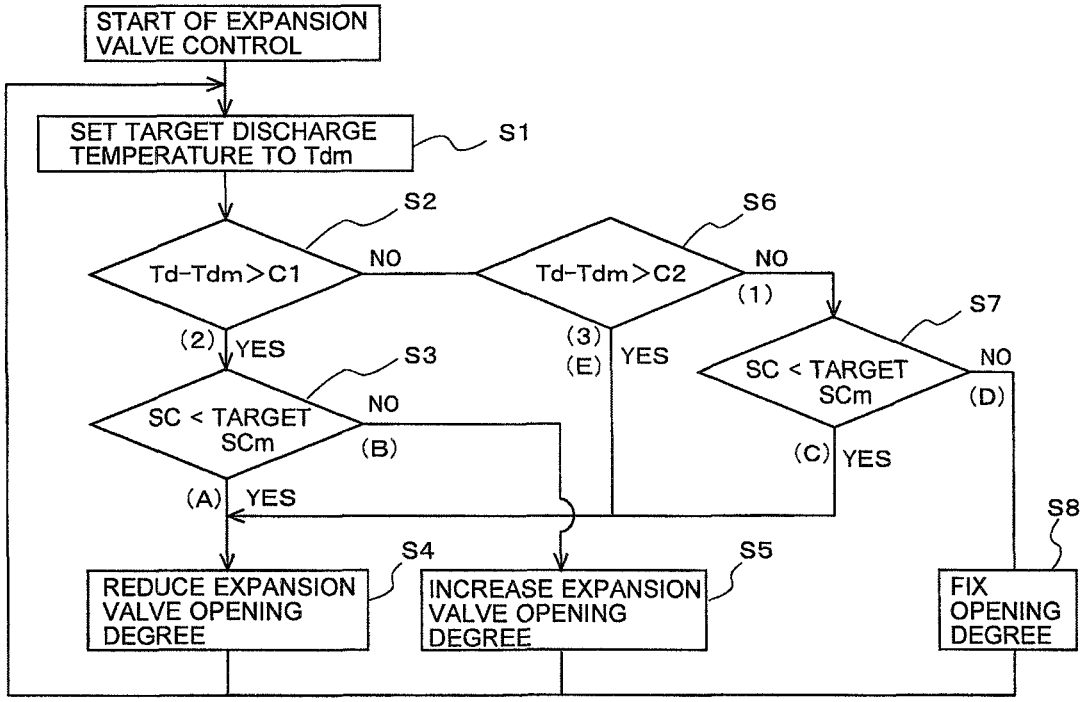
FIG. 10 is a flowchart illustrating a flow of expansion valve control in the refrigerating and air-conditioning apparatus according to Embodiment 1 of the present invention.

FIG. 10 is a flowchart illustrating a flow of expansion valve control in the refrigerating and air-conditioning apparatus according to Embodiment 1 of the present invention. Note that (1) to (3) and A to E in FIG. 10 correspond to (1) to (3) and A to E in FIG. 8. The opening degree of the expansion valve at the start of the refrigerating and air-conditioning apparatus is set, for example, to an opening degree determined in accordance with the operating condition (outside air temperature and indoor temperature) or the rotation speed of the compressor, or to an opening degree determined regardless of any condition. The set opening degree of the expansion valve is controlled so that it is closed more, opened more, or fixed in accordance with the flowchart of FIG. 10.

First, the refrigerating and air-conditioning apparatus 100 collects the current operation data to determine the current operating condition. Then, a condenser outlet supercooling degree SC which maximizes COP under the current operating condition is set as a target supercooling degree SCm. At the same time, the target discharge temperature is set to Tdm at which the target supercooling degree SCm is achieved (step S1). The target discharge temperature Tdm may be calculated by an approximate expression using outside air temperature and indoor temperature, condensing temperature and evaporating temperature, compressor rotation speed, or the like. Alternatively, the target discharge temperature Tdm may be calculated using a conversion table stored in the form of a table or a map.

The controller 50 calculates a difference ΔTd between the current discharge temperature Td detected by the discharge temperature sensor 41 and the target discharge temperature Tdm set in step S1, and compares the difference ΔTd with the predetermined value C1 set in advance (step S2). If the difference ΔTd is greater than the predetermined value C1, that is, if the current discharge temperature belongs to the range (2) in FIG. 8, the controller 50 compares the current condenser outlet supercooling degree SC with the target supercooling degree SCm (step S3). If the current condenser outlet supercooling degree SC is smaller than the target supercooling degree SCm, the current operating state corresponds to region A in FIG. 8. In this case, the controller 50 reduces the expansion valve opening degree to increase the condenser outlet supercooling degree SC (step S4). On the other hand, if the current condenser outlet supercooling degree SC is equal to or greater than the target supercooling degree SCm, the current operating state corresponds to region B in FIG. 8. In this case, the controller 50 increases the expansion valve opening degree (opens the expansion valve) to lower the condenser outlet supercooling degree SC (step S5).

If it is determined in step S2 that the difference ΔTd between the current discharge temperature and the target discharge temperature Tdm is equal to or smaller than the predetermined value C1, the controller 50 compares the difference ΔTd with the predetermined value C2 (step S6). If the difference ΔTd is greater than the predetermined value C2 in step S6, the current operating state corresponds to region E in FIG. 8 (which is the same as (3) in FIG. 8). In this case, the controller 50 reduces the expansion valve opening degree (step S4). On the other hand, if the difference ΔTd is equal to or smaller than the predetermined value C2, the current operating state corresponds to (1) in FIG. 8, and the controller 50 compares the condenser outlet supercooling degree SC with the target supercooling degree SCm (step S7). If the condenser outlet supercooling degree SC is smaller than the target supercooling degree SCm, the current operating state corresponds to region C in FIG. 8. In this case, the controller 50 reduces the expansion valve opening degree (step S4). On the other hand, if the condenser outlet supercooling degree SC is equal to or greater than the target supercooling degree SCm, the current operating state corresponds to region D in FIG. 8. In this case, the controller 50 fixes the expansion valve opening degree (step S8).

As described above, Embodiment 1 provides the refrigerant heat exchanger 4 that transfers heat between the high-pressure-side refrigerant flowing between the outdoor-unit liquid pipe connecting portion 11 and the expansion valve 3 and the low-pressure-side refrigerant on the outlet side of the accumulator 9. This makes it possible to ensure a sufficient temperature difference between the high-pressure-side refrigerant and the low-pressure-side refrigerant during heating operation. Thus, the low-pressure-side refrigerant flowing out of the accumulator 9 can be heated by the high-pressure-side refrigerant, gasified, and sucked into the compressor 1, so that liquid backflow can be suppressed. Therefore, it is possible to reduce a decrease in discharge temperature, maintain a proper discharge temperature, ensure a given heat exchange quantity in the indoor heat exchanger 6, and prevent degradation in heating performance.

In cooling operation, the high-pressure-side refrigerant flowing out of the refrigerant heat exchanger 4 is reduced in pressure by friction loss in components arranged downstream of the outdoor-unit liquid pipe connecting portion 11, that is, in the liquid pipe 5, the indoor heat exchanger 6, the gas pipe 7, etc. Since the refrigerant thus reduced in pressure flows to the low-pressure side of the refrigerant heat exchanger 4, a sufficient temperature difference between this refrigerant and the high-pressure-side refrigerant can be ensured. Thus, during cooling operation, as in the case of heating operation, the low-pressure-side refrigerant flowing out of the accumulator 9 can be heated by the high-pressure-side refrigerant and gasified. Therefore, the gas refrigerant can be sucked into the compressor 1 so that liquid backflow can be suppressed.

Additionally, a simple configuration can be achieved because, unlike the related art, there is no need to provide a bypass for preventing liquid backflow, in addition to the refrigerant heat exchanger 4. Thus, the refrigerating and air-conditioning apparatus 100 can be realized, which is simple in configuration but can obtain a sufficient heat exchange quantity in the refrigerant heat exchanger 4 in both cooling and heating operations, prevent degradation in heating performance, and reduce annual power consumption.

The specifications of the refrigerant heat exchanger 4 are selected such that AK/Gr and the temperature difference ΔT between the inlet temperature TM of the high-pressure-side refrigerant and the inlet temperature TL of the low-pressure-side refrigerant in the refrigerant heat exchanger 4 maintain a predetermined relationship (which satisfies expression (4)). This makes it possible to provide a refrigerating and air-conditioning apparatus 100 which can prevent liquid backflow to the compressor 1 caused by shortage of heat exchange quantity in the refrigerant heat exchanger 4, and can prevent an excess increase in discharge temperature caused by an excess heat exchange quantity in the refrigerant heat exchanger 4.

By using the discharge temperature as the main control target of the expansion valve 3 and correcting the operating direction of the expansion valve 3 with the condenser outlet supercooling degree SC, operation can be performed with maximum COP regardless of the operating condition.

Low-boiling refrigerants, such as R410A and R32, used in typical air conditioners are easy to increase in discharge temperature as the low pressure decreases. On the other hand, hydrocarbon refrigerants, such as R134a, R1234yf, R1234ze, and propane, which are high-boiling refrigerants, or mixtures thereof are harder to increase in discharge temperature than low-boiling refrigerants. Particularly, for example, in a refrigerant circuit where a sucked-in refrigerant easily turns into a two-phase gas-liquid refrigerant because of the presence of an accumulator, or under a low-compression ratio condition, it is difficult to ensure a given discharge superheat degree in the case of a high-boiling refrigerant. Also, when a high-boiling refrigerant is used for a compressor, such as a high-pressure shell, if the compressor shell is cooled before startup, the refrigerant may be condensed in the shell after startup. This may damage reliability due to a decrease in concentration of oil in the compressor. However, with the configuration of Embodiment 1 where the compressor 1 can heat the sucked-in refrigerant, a sufficient discharge superheat degree can be easily ensured even in the case of a high-boiling refrigerant which does not easily increase in discharge temperature. It is thus possible to reduce condensation of refrigerant in the compressor 1 at startup and to attain high reliability.

Embodiment 2

Generally, in a refrigerant circuit having an accumulator, the amount of liquid returned to the compressor 1 is smaller and the discharge temperature increases more easily than in a refrigerant circuit without an accumulator. Also, in Embodiment 1, where the two-phase gas-liquid refrigerant flowing out of the accumulator 9 is heated by the refrigerant heat exchanger 4, the discharge temperature increases more easily than a refrigerating and air-conditioning apparatus without the refrigerant heat exchanger 4. Therefore, it is necessary to take measures to reduce the discharge temperature in case of conditions under which the discharge temperature increases easily, such as in case of heating operation performed at a low outside air temperature. Embodiment 2 relates to a refrigerating and air-conditioning apparatus to which such measures are applied.

<Configuration>

Figure 11:
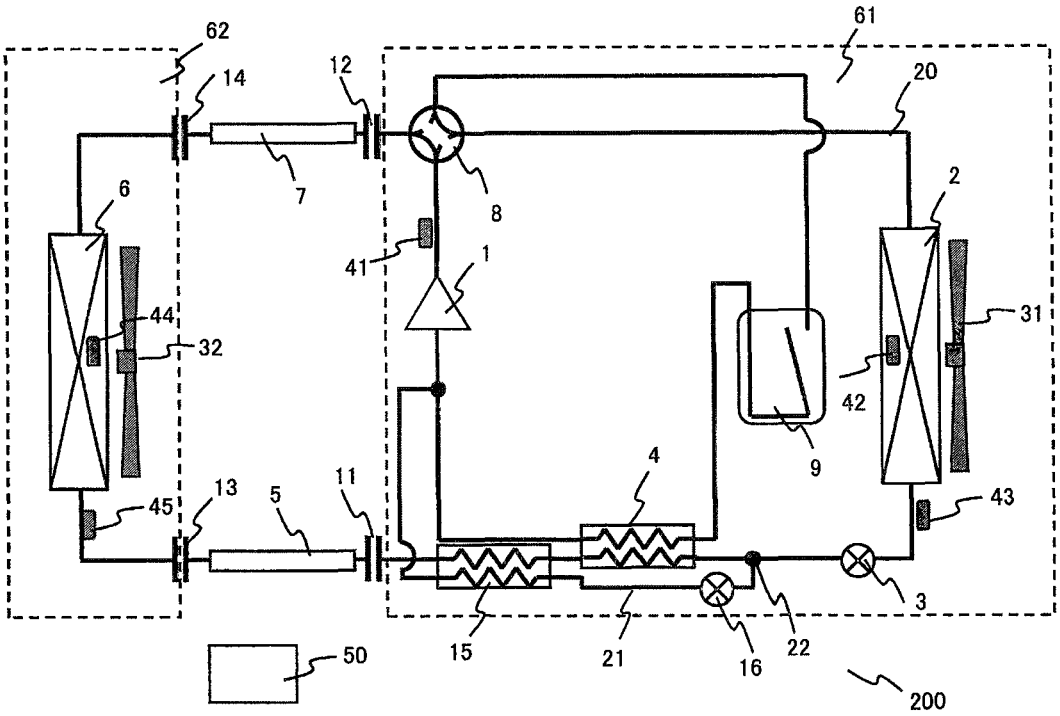
FIG. 11 illustrates the configuration of a refrigerating and air-conditioning apparatus according to Embodiment 2 of the present invention.

FIG. 11 illustrates the configuration of a refrigerating and air-conditioning apparatus according to Embodiment 2 of the present invention. The same components in FIG. 11 as those in Embodiment 1 are denoted by the same reference numerals as those in FIG. 1 described above. Modifications applied to some components of Embodiment 1 are also applicable to the same components of Embodiment 2 and Embodiment 3 described below. Differences between Embodiment 1 and Embodiment 2 will now be mainly described.

A refrigerating and air-conditioning apparatus 200 according to Embodiment 2 is obtained by adding a bypass 21 to the refrigerating and air-conditioning apparatus 100 according to Embodiment 1 illustrated in FIG. 1. The bypass 21 branches off between the refrigerant heat exchanger 4 and the expansion valve 3, passes through a bypass expansion valve 16 serving as a flow control valve, and joins a passage between the low-pressure-side outlet of the refrigerant heat exchanger 4 and the compressor 1. The bypass 21 is provided with an internal heat exchanger 15 that transfers heat between a pipe positioned downstream of the bypass expansion valve 16 for the bypass 21 and a pipe interposed between the outdoor-unit liquid pipe connecting portion 11 and the refrigerant heat exchanger 4. The bypass expansion valve 16 may have a variable opening degree, or may be a combination of an on-off valve and a capillary (not shown). Other configurations are the same as those of Embodiment 1.

<Operation of Bypass 21 and Internal Heat Exchanger 15>

The internal heat exchanger 15 cools a refrigerant between the outdoor-unit liquid pipe connecting portion 11 and the refrigerant heat exchanger 4 by transferring heat from this refrigerant to a refrigerant on the downstream side of the bypass expansion valve 16 for the bypass 21. This lowers the quality of vapor at the inlet portion of the outdoor heat exchanger 2 that serves as an evaporator during heating operation. On the other hand, because the refrigerant flowing out of the high-pressure side of the refrigerant heat exchanger 4 partially flows toward the bypass 21, the amount of refrigerant flowing into the evaporator (outdoor heat exchanger 2) is reduced. Thus, there is no gain or loss in the amount of heat processed by the evaporator (outdoor heat exchanger 2), and it is possible to reduce pressure loss in the evaporator (outdoor heat exchanger 2) and the low-pressure pipe (which extends from the evaporator to the compressor 1) and to reduce an increase in discharge temperature.

By regulating the opening degree of the bypass expansion valve 16, the bypass refrigerant which passes through the internal heat exchanger 15 in the bypass 21 can be moistened and joined to the refrigerant flowing from the low-pressure side of the refrigerant heat exchanger 4 toward the compressor 1. Therefore, even if the refrigerant flowing out of the low-pressure side of the refrigerant heat exchanger 4 is a superheated gas, the superheated gas is cooled by the refrigerant from the bypass 21, turns into a two-phase gas-liquid refrigerant, and flows into the compressor 1. It is thus possible to reduce an increase in discharge temperature.

In the refrigerating and air-conditioning apparatus 200 of Embodiment 2 configured as described above, the controller 50 performs control such that if the discharge temperature detected by the discharge temperature sensor 41 becomes equal to or higher than a predetermined discharge temperature upper limit, the bypass expansion valve 16 is opened to make the discharge temperature less than the discharge temperature upper limit.

As described above, Embodiment 2 can achieve the same effects as Embodiment 1. Additionally, with the bypass 21, it is possible to prevent an excess increase in discharge temperature under a low-outside-air heating condition where the discharge temperature easily increases, widen the range of operation, and achieve a high level of reliability.

Referring to FIG. 11, the bypass 21 branches off between the refrigerant heat exchanger 4 and the expansion valve 3. However, since the bypass 21 is provided in order to prevent an excess increase in discharge temperature, the position where the bypass 21 is located is not limited to this, and the bypass 21 can branch off anywhere between the outdoor-unit liquid pipe connecting portion 11 and the expansion valve 3. As long as the bypass 21 branches off between the outdoor-unit liquid pipe connecting portion 11 and the expansion valve 3, it is possible to ensure that the refrigerant at the inlet of the expansion valve 3 or the bypass expansion valve 16 is in a liquid state under a heating condition.

Because the internal heat exchanger 15 illustrated in FIG. 11 is located upstream of the refrigerant heat exchanger 4 in heating operation, it is possible to lower the temperature of the high-pressure-side refrigerant flowing into the refrigerant heat exchanger 4. This can reduce the heat exchange quantity in the refrigerant heat exchanger 4, and thus can suppress an increase in discharge temperature. With the internal heat exchanger 15, it is possible to reduce the flow rate of refrigerant which passes through the evaporator while the heat exchange quantity in the evaporator stays the same. Thus, it is possible to reduce pressure loss in the evaporator and on the low-pressure pipe side.

The position of the internal heat exchanger 15 is not limited to that illustrated in FIG. 11. For example, the internal heat exchanger 15 may be located downstream of the refrigerant heat exchanger 4 in heating operation. That is, the internal heat exchanger 15 can be provided anywhere between the outdoor-unit liquid pipe connecting portion 11 and a branch point 22 of the bypass 21. When the internal heat exchanger 15 is provided between the refrigerant heat exchanger 4 and the branch point, the pressure loss reduction effect during heating operation lowers, but an effect of reducing an increase in discharge temperature can be achieved. When the internal heat exchanger 15 is used for cooling, a large heat exchange quantity in the internal heat exchanger 15 can be obtained. Therefore, it is possible to achieve an effect of reducing the pressure in the evaporator and on the low-pressure pipe side.

Embodiment 3

Although Embodiment 2 has been described to show the bypass 21 having the internal heat exchanger 15, an increase in discharge temperature can be suppressed even without the internal heat exchanger 15. That is, the refrigerant reduced in pressure by the bypass expansion valve 16 is directly joined to the refrigerant flowing from the refrigerant heat exchanger 4 toward the compressor 1, so that the refrigerant flowing from the refrigerant heat exchanger 4 toward the compressor 1 is cooled and turns into a two-phase gas-liquid refrigerant. With this configuration, it is possible to make the refrigerant circuit 20 and its control operation simpler than those in Embodiment 2.

The invention claimed is:

1. A refrigerating and air-conditioning apparatus configured to operate in a cooling operation and in a heating operation, which comprises:

an outdoor unit including a compressor, a flow switching device, a refrigerant vessel, a heat-source-side heat exchanger, a pressure reducing device, and a refrigerant heat exchanger;

an indoor unit including a load-side heat exchanger;

a discharge temperature detecting device configured to detect a discharge temperature of a refrigerant discharged from the compressor;

a supercooling degree detecting device configured to detect a degree of supercooling of a refrigerant at an outlet of a heat exchanger serving as a condenser, the heat exchanger being one of the heat-source-side heat exchanger and the load-side heat exchanger;

a controller configured to control an opening degree of the pressure reducing device in accordance with the discharge temperature detected by the discharge temperature detecting device and the degree of supercooling detected by the supercooling degree detecting device; and a gas-side connecting pipe and a liquid-side connecting pipe each of which connects the outdoor unit to the indoor unit to form a refrigerant circuit including a different sequential arrangement of the compressor, the flow switching device, the load-side heat exchanger, the refrigerant heat exchanger, the pressure reducing device, the heat-source-side heat exchanger, and the refrigerant vessel in each of the cooling operation and the heating operation, wherein in the heating operation the refrigerant circuit includes uninterrupted and sequential flow of refrigerant from the refrigerant vessel to the refrigerant heat exchanger and from the refrigerant heat exchanger to the compressor in series, and the refrigerant heat exchanger transfers heat between a refrigerant flowing between the pressure reducing device and an outdoor-unit liquid pipe connecting portion which is a connecting portion of the liquid-side connecting pipe on a side of the outdoor unit and a refrigerant on an outlet side of the refrigerant vessel, wherein the controller sets a target supercooling degree and a target discharge temperature, the controller being configured to maximize operating efficiency of the apparatus based on a relationship between the target supercooling degree and the target discharge temperature maximizing operating efficiency of the apparatus, the relationship between the discharge temperature range of the compressor and the target supercooling degree including five regions as follows:

a first region including temperatures higher than an acceptable range of the target discharge temperature and a supercooling degree lower than the target supercooling degree, a second region including temperatures higher than the acceptable range of the target discharge temperature and a supercooling degree higher than the target supercooling degree, a third region including temperatures within the acceptable range of the target discharge temperature and a supercooling degree lower than the target supercooling degree, a fourth region including temperatures within the acceptable range of the target discharge temperature and a supercooling degree higher than the target supercooling degree, and a fifth region including temperatures lower than the acceptable range of the target discharge temperature; and wherein the controller is configured to:

close the opening degree of the pressure reducing device more where the discharge temperature detected by the discharge temperature detecting device and the degree of supercooling detected by the supercooling degree detecting device belong to one of the first region, the third region and the fifth region of the five regions, fix the opening degree of the pressure reducing device where the discharge temperature detected by the discharge temperature detecting device and the degree of supercooling detected by the supercooling degree detecting device belong to the fourth region of the five regions, and increase the opening degree of the pressure reducing device where the discharge temperature detected by the discharge temperature detecting device and the degree of supercooling detected by the supercooling degree detecting device belong to the second region of the five regions.

2. The refrigerating and air-conditioning apparatus of claim 1, wherein a ratio [J/kgK] of a heat conductance AK which is a product of a heat transfer area and a heat transmission coefficient of the refrigerant heat exchanger to a refrigerant flow rate Gr of the refrigerant on the outlet side of the refrigerant vessel, which passes through a low-pressure side of the refrigerant heat exchanger satisfies a relation:

$$1.40\times102(TM-TL)\leq AK/Gr\leq1.52\times105/(TM-TL)$$

where TM is an inlet temperature of the high-pressure-side refrigerant in the refrigerant heat exchanger, and TL is an inlet temperature of the low-pressure-side refrigerant in the refrigerant heat exchanger.

3. The refrigerating and air-conditioning apparatus of claim 1, further comprising a bypass configured to branch off between the outdoor-unit liquid pipe connecting portion and the pressure reducing device, pass through a flow control valve, and join a passage between the refrigerant vessel and the compressor.

4. The refrigerating and air-conditioning apparatus of claim 3, wherein the controller sets a predetermined upper limit for the target discharge temperature, and where the discharge temperature detected by the discharge temperature detecting device is equal to or higher than the upper limit for the target discharge temperature, the controller is configured to open the flow control valve for reducing the discharge temperature to lower than the upper limit for the target discharge temperature.

5. The refrigerating and air-conditioning apparatus of claim 3, further comprising an internal heat exchanger configured to transfer heat between a refrigerant flowing between the outdoor-unit liquid pipe connecting portion and a branch point of the bypass and a refrigerant on a downstream side of the flow control valve of the bypass.

* * * * *